United States Patent [19]

Cutler et al.

[11] 4,303,545

[45] Dec. 1, 1981

[54] HOT ROLL CLEANING PASTE AND METHOD

[75] Inventors: Robert S. Cutler; Robert M. Lindquist, both of Boulder, Colo.

[73] Assignee: International Business Machines Corporation, Armonk, N.Y.

[21] Appl. No.: 151,485

[22] Filed: May 19, 1980

[51] Int. Cl.[3] ..... C11D 1/72; C11D 3/14; C11D 7/02

[52] U.S. Cl. ..... 252/174.21; 134/42; 252/174.23; 252/174.25

[58] Field of Search ..... 252/174.25, 174.21, 252/174.23; 134/42, 38; 430/125

[56] References Cited

U.S. PATENT DOCUMENTS

| | | | |
|---|---|---|---|
| 3,150,048 | 9/1964 | Hollub et al. | 252/163 X |
| 3,848,305 | 11/1974 | Jachimiak | 29/132 |
| 3,861,860 | 1/1975 | Thettu et al. | 432/59 |
| 3,955,813 | 5/1976 | Edwards | 271/174 |
| 3,956,162 | 5/1976 | Lautenberger | 252/162 |
| 3,980,423 | 9/1976 | Latone | 432/75 |
| 4,013,400 | 3/1977 | Thettu et al. | 432/75 |
| 4,050,803 | 9/1977 | McCarroll | 355/3 R |
| 4,110,068 | 8/1978 | Brown et al. | 432/60 |

OTHER PUBLICATIONS

Burger et al., "Effective, Simple Technique for Cleaning Hot Fuser Rolls in the Field," IBM Technical Disclosure Bulletin, vol. 22, No. 4, Sep. 1979, p. 1376.

Moser, R., et al., "Roll Cleaner Fluid and Method", Xerox Disclosure Journal, vol. 3, No. 3, May/Jun. 1978, pp. 161-163.

*Primary Examiner*—P. E. Willis, Jr.

*Attorney, Agent, or Firm*—Francis A. Sirr

[57] ABSTRACT

A cleaning paste for use in cleaning the hot portions of a xerographic hot roll fuser, the paste comprising a mixture of a high molecular weight penetrant, e.g., a plasticizer or surfactant, cleansing agent and a finely divided solid to provide a bodying effect to the cleansing agent.

6 Claims, No Drawings

HOT ROLL CLEANING PASTE AND METHOD

DESCRIPTION

Technical Field

The present invention relates to the field of xerographic hot roll fusing and to the cleaning of such a fuser's hot, toner-contaminated members, particularly the hot roll itself.

BACKGROUND OF THE INVENTION

A hot roll fuser is a preferred means of fusing dry, particulate toner to copy paper. In this fuser a pair of cylindrical rollers, in pressure contact, form a hot nip through which the copy paper passes. In a xerographic process, one means or another is used to form a relatively loose toner image on a photoconductor. A transfer station provides a means by which a portion of this toner image is transferred to a sheet of copy paper. The sheet of paper now carries a relatively loose toner image on one surface thereof. The paper then passes through the fusing nip whereat the toner thereon is melted or fused to the paper to form a permanent copy.

In an exemplary hot roll fuser, of the type shown in U.S. Pat. No. 4,110,068, incorporated herein by reference, the toner side of the paper engages a relatively soft heated roll, whereas the other side of the paper engages a rigid cool roll. The soft heated roll is essentially a rigid aluminum core to which is adhered a layer of silicone elastomeric material, for example as described in U.S. Pat. No. 3,848,305, incorporated herein by reference.

The ability of the copy paper's leading edge to release from the fuser roll, and primarily the hot roll, is a function of the state of the hot roll's surface cleanliness. As a result, it is necessary to periodically manually clean this surface of filmed-on-toner, paper dust, rosin, etc. In addition, if residual toner remains on the hot roll, ghost images may result on subsequent copies.

Release of the paper from the hot roll can be aided by use of a pneumatic peeler bar of the type described in U.S. Pat. No. 3,955,813, incorporated herein by reference. This peeler bar itself is exemplary of a hot, toner-contaminated member which can be advantageously cleaned by use of the present invention.

In practice, manual cleaning of these fuser members usually takes place while these parts are at an elevated temperature. Thus, a cleaning means should, ideally, not become excessively fluid or volatile at higher than ambient temperatures, and of course must be non-toxic.

As an example of prior teachings relative the cleaning of hot roll fusers, the IBM TECHNICAL DISCLOSURE BULLETIN of September 1979, at page 1376, describes the use of a concentrated, non-ionic, water soluble surfactant such as iso-octylphenoxy-polyethoxyethanol to clean either the hot or the cold roll. This surfactant is applied by the use of a felt tip graphic art pen or a nylon mesh pad, and cleaning is followed by a 25 sheet cycle of the copier to remove residual surfactant from the fuser.

In other prior art, such as U.S. Pat. No. 4,050,803 and the XEROX DISCLOSURE JOURNAL of May/June 1978, at pages 161, 162 and 163 the cleaning action of a wet release hot roll fuser's felt pad is enhanced by mixing a functional polysiloxane fluid with silicone oil.

Yet other attempts to clean a hot roll fuser have included cleaning rollers which engage one of the two rollers during copy production. In U.S. Pat. No. 3,861,860, such a cleaning roller is formed of a polyester polymer material, whereas in U.S. Pat. No. 3,980,423 the cleaning roller comprised a layer of toner coated with a thin layer of silicone oil, and in U.S. Pat. No. 4,013,400 the cleaning roller is silicone rubber whose outer surface is tacky as a result of incomplete curing.

The Invention

The present invention provides a method of manually cleaning hot portions, for example the hot roll, of a hot roll fuser by the use of a cleaning paste which remains viscous, is non-toxic, and volatilizes only to a limited extent, at the elevated temperature usually associated with a hot roll fuser, for example 365° F. As a result, the cleaning paste of the present invention is easy to handle during use, does not result in contamination of other copier or fuser components, as by the dripping of cleaning material thereon, and the like, and does not provide an uncomfortable environment, i.e. flammability or odor for the person cleaning the hot roll fuser.

More specifically, these benefits are provided by selecting a high molecular weight cleaning paste which includes finely divided solids such as graphite, diatomaceous earth (Celite brand), fullers earth and/or colloidal pyrogenic silica pigment (Cab-O-Sil brand).

By selecting plasticizer and/or surfactant penetrant materials having high molecular weight, problems of volatility and flammability are minimized. By the term penetrant is to mean materials which tend to penetrate, soften, be absorbed by, and/or have an affinity for the polymeric constituents of toner. However, this selection parameter alone results in a material whose viscosity lowers at the elevated temperatures usually associated with hot roll cleaning, such that these now-more-fluid materials tend to flow down the hot surface, to contaminate material located therebelow. The addition of heat-stable, finely divided solids to these high molecular weight materials, which materials do not of themselves smell or smoke when applied to the heated parts, thickens these materials to a grease or paste-like consistency which does not run or drip when applied to the heated parts. This thickening action is also known as bodying action, and a cleaning paste formulated in accordance with the teaching of the present invention retains this bodying action at the elevated temperatures associated with hot roll fusers. Solid material graphite is particularly useful in that it also enhances the cleaning action of the resulting paste cleaner. A combined solid additive of silica pigment and celite is also particularly useful.

It has been noted that plasticizer and surfactant penetrants having too high a molecular weight have a reduced penetrating action. That is, the paste's cleaning ability is reduced in that the toner is not softened and released from the roll's surface as discrete particles, to thereafter be carried away as the paste is wiped off the roll. As specific examples, exemplary plasticizers found acceptable are in the molecular weight range of about 2200 to 3800, whereas exemplary surfactants are in the molecular weight range of about 500 to 2000.

By way of a more specific example, the following have been found to be acceptable: polyester plasticizer MW (molecular weight) 2200 (Chem Service, Inc.), polyester plasticizer MW 3380 (Chem Service, Inc.), polyester plasticizer MW 6000 (Chem Service, Inc.), polyethoxylated t-octyl phenols 7–40 moles EtO surfactants (Triton brand), di(tridecyl) phthalate plasticizer, polyethoxylated tallow amide 50 moles EtO, polyethoxylated oleyl alcohols 10–20 moles EtO, polyethoxylated stearyl amines 5–50 moles EtO, polyethoxylated soya amine 15 moles EtO, epoxidized soy bean oil, soy bean oil, partially hydrogenated soy bean oil, and glycerol trioleate.

By the general term plasticizer, without limitation to high molecular weight plasticizers, is meant a material normally added to a plastic to facilitate compounding and improve flexibility and other properties of the finished product. Examples of well known plasticizers are nonvolatile organic liquids or low-melting solids, especially the phthalate, adipate and sebacate esters, aryl phosphate esters, and polyol alcohols.

By the general term surfactant, again without limitation to high molecular weight surfactants, is meant any compound that affects, i.e. usually reduces, surface tension when dissolved in water or water solutions, or which similarly affects interfacial tension between two liquids.

In testing plasticizer/surfactant materials in mixture with finely divided, i.e. powder-like solids, the testing method selected was to screen copiers, and particularly their hot roll fusers, which had been returned to the factory for reconditioning after extended use by customers. Severely contaminated fusers were selected such that the severity of contamination was generally of the same class. The fuser hot rolls were heated to fuser operating temperature. The selected mixtures were used to manually remove contamination from a given area of the heated hot roll, for example 1 to 3 square inches.

Objective judgment was used in rating the mixture's cleaning rate in a bad-to-good scale of 0 to 5 (0=no cleaning action, whereas 5=cleaning with minimal time and effort), using the criteria of the time necessary to remove the contamination, such as baked-on toner, while applying a uniform physical scrubbing effort throughout the measured time interval.

A first test procedure of this type involved only the search for proper plasticizer/surfactant material taking into account its cleaning rating and its generation of smoke or odor at the elevated fusing temperature when cleaning a hot fuser roll having toner contamination which was not so severe as to be classified as baked-on-toner. Table I gives these results.

TABLE I

Hot Roll Cleaning Action at 365° F.

| | | Cleaning Rating | Smoke or Smell |
|---|---|---|---|
| 1 | Dimethyl Siloxane DC200 | 0 | Yes |
| 2 | Mineral Oil | 0 | Yes |
| 3 | Polybutadiene low MW | 0 | Yes |
| 4 | Polyester MW 850 | 4½ | Yes |
| 5 | Polyester MW 2200 | 4½ | No |

TABLE I-continued

Hot Roll Cleaning Action at 365° F.

| | | Cleaning Rating | Smoke or Smell |
|---|---|---|---|
| 6 | Polyester MW 3380 | 4 | No |
| 7 | Polyester MW 6000 | 1 | No |
| 8 | Polyethoxylated t-octyl phenol 1 mole EtO | 4½ | Yes |
| 9 | Polyethoxylated t-octyl phenol 3 mole EtO | 4½ | Yes |
| 10 | Polyethoxylated t-octyl phenol 5 mole EtO | 4½ | Yes |
| 11 | Polyethoxylated t-octyl phenol 7–8 mole EtO | 4½ | No |
| 12 | Polyethoxylated t-octyl phenol 9–10 mole EtO | 4½ | No |
| 13 | Polyethoxylated t-octyl phenol 12–13 mole EtO | 4½ | No |
| 14 | Polyethoxylated t-octyl phenol 16 mole EtO | 4½ | No |
| 15 | Polyethoxylated t-octyl phenol 30 mole EtO | 4½ | No |
| 16 | Polyethoxylated t-octyl phenol 40 mole EtO | 4½ | No |

From this table it can be seen that examples 5 and 6 and 11–16 are acceptable cleaners.

Next, the materials of examples 6 and 12, as well as three further plasticizers were tested both as cleaning materials per se and in mixture with powdered graphite and Celite. Table II shows the results of this test on a heated hot roll having more severe toner contamination which could be classed as baked-on-toner.

TABLE II

Hot Roll Cleaning Action at 365° F.

| | | Cleaning Rating | | | | |
|---|---|---|---|---|---|---|
| | | Material Per Se | Cleansing Agent/ Additive Graphite | By Wt. Ratio | Cleansing Agent/ Additive Celite | By Wt. Ratio |
| 17 | Di(tridecyl)phthalate | 3 | 4½ | 1 to 1.5 | 4½ | 2 to 1 |
| 18 | Polyester MW 3380 | 3 | 4½ | 1 to 1.5 | 4½ | 2 to 1 |
| 19 | Epoxidized soy bean oil | 3½ | 4½ | 1 to 1.5 | 4½ | 2 to 1 |
| 20 | Polyethoxylated t-octyl phenol 9–10 mole EtO | 3½ | 4½ | 1 to 1.5 | 4½ | 2 to 1 |
| 21 | Partially hydrogenated soy bean oil | 3 | 4½ | 1 to 1.5 | 4½ | 2 to 1 |

From this table it can be seen not only that all materials per se are acceptable in their cleaning actions, but that cleaning action improves with the addition of graphite or Celite. It can also be seen that the cleaning action increases with addition of the finely divided solids. In all of the examples 17–21 the mixtures listed possessed a paste-like consistency, and did not run or volatilize in a heated environment of 365° F.

Next a test was run to determine the bodying action achieved by changing the ratio by weight of the plasticizer/surfactant cleansing agent to the solid additive, for four selected cleansing agents. The mixtures of the following examples 22–34 were touched to the heated hot roll while the roll's axis was horizontal, and at two positions identified as 10° and 90° about its circumference, 0° being the uppermost point on this circumference. The result is given in Table III.

TABLE III

Bodying Action of Additives on Cleansing Agents

| | | Additive | Cleansing Agent/ Additive By Wt. Ratio | Flow on Heated Hot Roll at 10°/90° |
|---|---|---|---|---|
| 22 | Partially hydrogenated soy bean oil | Graphite | 2/1 | No/Yes |
| 23 | Partially hydrogenated soy bean oil | Graphite | 1/1 | No/Yes |
| 24 | Partially hydrogenated soy bean oil | Graphite | 1/1.5 | No/No |
| 25 | Partially hydrogenated soy bean oil | Celite | 3/1 | No/Yes |
| 26 | Di(tridecyl)phthalate | Graphite | 2/1 | Yes/Yes |
| 27 | Di(tridecyl)phthalate | Graphite | 1/1 | No/Yes |
| 28 | Di(tridecyl)phthalate | Celite | 4/1 | Yes/Yes |
| 29 | Di(tridecyl)phthalate | Celite | 2/1 | No/No |
| 30 | Polyester MW 2200 | Graphite | 2/1 | No/Yes |
| 31 | Polyester MW 2200 | Celite | 4/1 | No/Yes |
| 32 | Polyester MW 2200 | Celite | 2/1 | No/No |
| 33 | Polyethoxylated t-octyl phenol 9-10 mole EtO | Graphite | 3/1 | Yes/Yes |
| 34 | Polyethoxylated t-octyl phenol 9-10 mole EtO | Graphite | 1/1.5 | No/Yes |

From this it can be seen that examples 24, 29 and 32 are superior.

Summarizing these tests, it is seen that examples 5, 6 and 11-16 are good cleansing agents per se. Of these, the cleansing agents of examples 5, 6 and 12 were selected for testing in mixture, as examples 32, 18 and 20 respectively, and produced superior cleaning results. Further, the high molecular weight cleaning agents per se of examples 17, 19 and 21, i.e. di(tridecyl) phthalate, epoxidized soy bean oil and partially hydrogenated soy bean oil, were tested in mixture with selected finely divided solids, including the testing of heat flow of example 17 (see example 29), to show the superior characteristics of these plasticizer/surfactant mixtures.

Particularly effective cleansing pastes according to this invention are formulated from the above-described plasticizer/surfactant materials by the combined addition of Cab-O-Sil for its bodying action and Celite for attack on baked-on toner.

As a result, preferred cleaning paste formulations (% by wt.) were identified as

EXAMPLE 35

| | |
|---|---|
| Polyethoxylated t-octyl phenol 9-10 mole EtO | 71.2% |
| Celite | 22.4% |
| Cab-O-Sil | 6.4% |

EXAMPLE 36

| | |
|---|---|
| Partially hydrogenated soy bean oil | 71.2% |
| Celite | 22.4% |
| Cab-O-Sil | 6.4% |

EXAMPLE 37

| | |
|---|---|
| Polyethoxylated t-octyl phenol 9-10 mole EtO | 40.0% |
| Graphite | 60.0% |

Example 35 is a particularly preferred paste composition since it can be removed from the heated hot roll, after cleaning, by the simple expedient of wiping with a water-wet towel.

While a preferred embodiment of the invention has been described, it is to be understood that the present invention is not limited to this precise disclosure, and that the invention is defined by the scope of the appended claims.

What is claimed is:

1. A cleaning paste comprising a mixture of about 71% by weight polyethoxylated t-octyl phenol 9-10 mole EtO, about 22% by weight diatomaceous earth, and about 7% by weight colloidal pyrogenic silica pigment.

2. A cleaning paste comprising a mixture of about 71% by weight partially hydrogenated soy bean oil, about 22% by weight diatomaceous earth, and about 7% by weight colloidal pyrogenic silica pigment.

3. A cleaning paste comprising a mixture of about 40% by weight polyethoxylated t-octyl phenol 9-10 mole EtO, and about 60% by weight powdered graphite.

4. A method of manually cleaning toner residue from the hot toner-contaminated members of a hot roll fuser by the step of rubbing said members with a cleaning paste comprising a mixture of about 71% by weight polyethoxylated t-octyl phenol 9-10 mole EtO, about 22% by weight diatomaceous earth, and about 7% by weight colloidal pyrogenic silica pigment.

5. The method of manually cleaning toner residue from the hot toner-contaminated members of a hot roll fuser by the step of rubbing said members with a cleaning paste comprising a mixture of about 71% by weight partially hydrogenated soy bean oil, about 22% by weight diatomaceous earth, and about 7% by weight colloidal pyrogenic silica pigment.

6. The method of manually cleaning toner residue and the like from the hot contaminated members of a hot roll fuser by the step of rubbing said members with a cleaning paste comprising a mixture of about 40% by weight polyethoxylated t-octyl phenol 9-10 mole EtO, and about 60% by weight powdered graphite.

* * * * *